United States Patent [19]

Yazu

[11] Patent Number: 5,054,073

[45] Date of Patent: Oct. 1, 1991

[54] VOICE ANALYSIS AND SYNTHESIS DEPENDENT UPON A SILENCE DECISION

[75] Inventor: Takashi Yazu, Tokyo, Japan

[73] Assignee: Oki Electric Industry Co., Ltd., Tokyo, Japan

[21] Appl. No.: 453,149

[22] Filed: Dec. 19, 1989

Related U.S. Application Data

[63] Continuation of Ser. No. 127,257, Dec. 1, 1987, abandoned.

[30] Foreign Application Priority Data

Dec. 4, 1986 [JP] Japan ..... 61-289708

[51] Int. Cl.[5] ..... G10L 5/00

[52] U.S. Cl. ..... 381/37; 381/30; 381/31; 381/36

[58] Field of Search ..... 364/513.5; 381/29-40

[56] References Cited

U.S. PATENT DOCUMENTS

| | | | |
|---|---|---|---|
| 4,110,560 | 8/1978 | Leary et al. | 381/31 |
| 4,280,192 | 7/1981 | Moll | 381/35 |
| 4,374,304 | 2/1983 | Flanagan | 381/29 |
| 4,376,874 | 3/1983 | Karban et al. | 381/34 |
| 4,455,649 | 6/1984 | Esteban et al. | 381/31 |
| 4,703,480 | 10/1987 | Westall et al. | 381/30 |
| 4,704,730 | 11/1987 | Turner et al. | 381/36 |

OTHER PUBLICATIONS

Tanenbaum, Computer Networks, 1981 by Prentice-Hall, Inc., Englewood Cliffs, N.J., pp. 104-108.

The Bell System Technical Journal, vol. 55, No. 8, Oct. 1976, pp. 1069-1085, "Digital Coding of Speech in Sub-bands", by R. E. Crochiere et al.

*Primary Examiner*—David D. Harkcom
*Assistant Examiner*—Gary V. Knepper
*Attorney, Agent, or Firm*—Spencer & Frank

[57] ABSTRACT

In a method and apparatus for the analysis and synthesis of voice signals wherein frequency bands of voice signals are divided into several sub-bands with subsequent separate coding and synthesis of each subdivision channel signals, the amplitude level of each subdivision channel signal in a predetermined interval of time (frame length) is evaluated and only those subdivision channel signals for which the above-mentioned amplitude level exceeds a predetermined reference level established for each subdivision channel is coded.

6 Claims, 8 Drawing Sheets

14a
114a
CODER
37
BUFFER
ak(SR)
ΔQk(i)
ΔQk(i) DECODING UNIT
32
TABLE ROM
33
31
SILENCE CONFIRMATION CIRCUIT
30
Δqk(i)
ΔQk(i) CODING UNIT
28
TABLE ROM
29
27
QUANTIZATION LEVEL CONVERSION CODING UNIT
21a SILENCE DETECTOR
24a LEVEL EVALUATION UNIT
amax
26
MAXIMUM VALUE DETECTION CIRCUIT
25 ABSOLUTE VALUE DETECTOR
|ak(SR)|
23a AMPLITUDE LEVEL DETECTOR

| | |
|---|---|
| 0 | (QUANTIZATION LEVEL )$_0$ |
| 1 | (QUANTIZATION LEVEL )$_1$ |
| 2 | (QUANTIZATION LEVEL )$_2$ |
| 3 | (QUANTIZATION LEVEL )$_3$ |
| ⋮ | ⋮ |
| j | (QUANTIZATION LEVEL )$_j$ |
| ⋮ | ⋮ |
| M | (QUANTIZATION LEVEL )$_M$ |

| | |
|---|---|
| 0 | — |
| 1 | $\Delta Q_1$ |
| 2 | $\Delta Q_2$ |
| 3 | $\Delta Q_3$ |
| ⋮ | ⋮ |
| j | $\Delta Q_j$ |
| ⋮ | ⋮ |
| M | $\Delta Q_M$ |

$S_K(\omega)$
$W_K$
$-W_{2K}$
$-W_{1K}$
0
$W_{1K}$
$W_{2K}$ $\cos W_{1K} n$
$-W_{1K}$
0
$W_{1K}$ $R_K(\omega)$
$-W_K$
0
$W_K$ $\cos W_{1K} n$
$-W_{1K}$
0
$W_{1K}$ $\tilde{S}_K(\omega)$
$-W_{2K}$
$-W_{1K}$
0
$W_{1K}$
$W_{2K}$

VOICE ANALYSIS AND SYNTHESIS DEPENDENT UPON A SILENCE DECISION

This application is a continuation of application Ser. No. 07/127,257, filed Dec. 1, 1987, now abandoned.

BACKGROUND OF THE INVENTION

The present invention relates to a method and apparatus for the analysis and synthesis of voice signals.

Known in the art is a band-division type voice analysis and synthesis system (i.e., a sub-Band Coding System which will be hereinafter referred to as an "SBC system"), which is described in the Bell System Technical Journal, 55 [8], 1976-10, USA. This SBC system divides the frequency band of voice signals into several sub-bands (normally, 4 to 8) of the type shown in FIG. 4 (where these sub-bands are designated by reference numerals 1, 2, 3 and 4), and the output of each sub-band channel is then separately coded and decoded.

A basic configuration of the SBC system is shown in the block diagram of FIG. 5 while FIGS. 6A to 6E explain the operation of various circuits. The SBC system will be further described with reference to the above-mentioned FIGS. 5 and 6A to 6E.

First, the operation of an analyzer will be considered. An analog voice signal which is obtained from a microphone (not shown), or a similar source, is passed through a low-pass filter (not shown) for filtering-out the frequency components exceeding ½ of a predetermined sampling frequency. The signal is then converted by an A/D converter (not shown) from the analog form into a digital signal S(n) at a predetermined sampling frequency, where n is a sample number. This digitized input signal S(n) is supplied to a band-pass filter 50. In FIG. 6A this signal is described as a specific band component ($W_{1k}-W_{2k}$). The output signal of the above-mentioned band-pass filter 50 is subjected to cosine modulation by multiplying in a multiplier 51 by a cosine wave (Cos wave) having a $W_{1k}$ frequency shown in FIG. 6B. The signal is then shifted to the basic band ($0-W_k$) shown in FIG. 6C. The unwanted frequency components $R_k(\omega)$ which are formed in this case and exceed $2W_{1k}$ (e.g., the components which are shown by broken lines in FIG. 6C) are removed by passing through a low-pass filter 52. Because a signal $r_{k(n)}$ obtained after passing through filter 52 should be the only component that is below $W_k$, sampling at the sampling frequency of $2W_k$ will produce the information which is necessary and sufficient. Therefore, decimation is performed by means of a decimator 53, if necessary, with dropping of the high sampling frequency to the rate $2W_k$ (a high sampling frequency may be required, e.g., in the case of low-pass translation). The obtained decimated signals are coded by a coder 54, and the coded signals are transmitted to a synthesizer.

Because in the synthesizer the signals are processed entirely opposite to the analyzer, the signals obtained from the analyzer are decoded. More specifically, after decoding the coded signals by a decoder 55, interpolation is performed by an interpolator 56 for the return of the decimated signals to their initial sampling frequency. Output signals of interpolator 56 are demodulated by multiplying in a multiplier 57 by a cosine wave having a frequency of $W_{1k}$ shown in FIG. 6D and returned from the basic band ($0-W_k$) to the initial frequency band ($W_{1k}-W_{2k}$), as shown in FIG. 6E. Then all other component of the signal, except for those having the frequency band ($W_{1k}-W_{2k}$), are removed by passing through a band-pass filter 58.

The output from the synthesizer comprises signal Sk(n).

The above-described chain of operation is performed for each sub-band (channel), and finally the outputs of all of the channels are summarized into an output voice signal.

A modification of the SBC system is shown in FIG. 7. This system in general is similar to that of FIG. 5, but in order to reduce the number of circuits, it is realized without band-pass filters 50 and 58.

The circuit shown in FIG. 7 operates in the following manner:

In an analyzer, a digitized input signal S(n) is modulated into a complex signal $e^{jwkn}$[where $\omega_k=(W_{1k}+W_{2k})/2$]. This complex signal is then complex-modulated in a multiplier 61*a* by cosine modulation (modulation wave $\cos\omega_{kn}$), and in a multiplier 61*b* by sine modulation (modulation wave $\sin\omega_{kn}$). The output signals of multipliers 61*a* and 61*b* are filtered through low-pass filters 62*a* and 62*b* with bandwidths ($0-\omega_k/2$). The resulting signal from low-pass filter 62*a* will correspond to the real part $a_{k(n)}$ of complex signal $a_{k(n)}+jb_{k(n)}$, and the resulting signal from low-pass filter 62*b* will correspond to the imaginary part $b_{k(n)}$ of complex signal $a_{k(n)}+jb_{k(n)}$. The signals $a_{k(n)}$ and $b_{k(n)}$ are decimated to frequency $W_k$ by decimators 63*a* and 63*b*, respectively, and are coded by a coder 64, and transmitted to a synthesizer. In the synthesizer, the coded signals are decoded by a decoder 65, returned to their initial sampling frequency by interpolators 66*a* and 66*b*, and then subjected to filtering by passing through-a low-pass filters 67*a* and 67*b* having a ($0-\omega_k/2$) bandwidth. The signals are then demodulated in a multiplier 68*a* by being multiplied by the cosine wave, and in a multiplier 68*b* by the sine wave. Cosine components and sine components of the signals are added to each other in an adder 69, and the signals of the above-mentioned sub-bands are thus synthesized.

The above-described processing is repeated for each sub-band (channel). Finally, the output signals of all channels are summed, and output voice signals are obtained.

As compared to a system coding a voice signal itself, the SBC system, which operates on the above principle, has the following advantages:

The quantization error of each channel is similar to white noise and spreads over the entire width of the frequency spectrum, but because the noise outside of each individual channel does not fall in the particular channel, the quantization noise can be reduced. Furthermore, the quantization error of each channel is related only to signals to signals within the frequency band of this particular channel, and is such signals as voice with high low-frequency components and low high-frequency components, the errors in the channels of the high-frequency bands are extremely small as compared to the signal as a whole. In addition, the high-frequency components of the voice signal are mainly components of the noise, and the error in this band only slightly affects hearing.

By setting an appropriate division of the speech spectrum and appropriate quantization bit numbers which are given to the signals of respective channels it becomes possible to reduce the required quantity of information to about one half, as compared to a system based on direct coding of the voice signals. For example, in the case of PCM voice signals sampled at 8 KHz, the direct coding, e.g., ADPCM coding requires a quantity of information corresponding approximately to 30 kb/s, whereas in the SBC system, the synthesized sound, almost of the same quality for hearing, can be obtained at about 16 kb/s.

It is desired that sound of high quality be synthesized using a smaller amount of information. Because in general the SBC system is basically a wave-form coding system, information compression in this system is limited to 10 kb/s. As the quantization bit number in this range appears to be insufficient, "roughness" of the synthesized sound is noticeable because of quantization error, or the quality of the sound is lowered because of insufficiency of the band.

As is well known, however, conventional telephone voice signals contain a considerable quantity of silence signal intervals. This is, of course, conversation break pauses, respiration pauses during continuous speech, or bursting sounds which are accompanied by closing time intervals. In total, the silence signals comprise about 20% of the time, and this time, which is useless, is processed in the same manner as the voice intervals which carry information. In addition, systems such as SBC systems with sub-bands, may include channels with an amplitude, as well as channels which are almost without the amplitude. The human ear distinguishes sounds by position and magnitude of a peak (formant) on the spectrum of the voice. Those parts which are in the "valley" portions of the spectrum carry information of relatively low importance. Furthermore, it often happens that sounds which have a low level of voice signals are almost below the noise level. From a practical viewpoint, these portions also can be treated as silence signals, almost without any lose of phonetic properties of the speech. Because in silence compression in the voice analysis and synthesis systems which do not subdivide frequency bands into sub-bands a judgement is made on the collection of sound signals and silence signals over the entire band, with a high slice lever for sound/silence judgment, low power sound signals such as friction sounds can be taken for silence signals and lost, and with a low slice level, pure noise intervals can be taken for sound, and effective compression of information cannot be achieved.

Because, distinct from the noise spectrum, the spectrum of the voice has specific deviations characteristic of the phonetic (vocal) properties of the voice sounds, it is possible to subdivide the voice signals into several sub-bands and to make a judgment on the silence in each separate sub-band. With such an arrangement, even when the voice power is low in an entire band, reservation of components of the sub-band in which the power is concentrated is ensured, while the remaining information of the band containing only noise components is removed. As a result, the phonetic properties of the voice are preserved, while effective information compression is achieved.

SUMMARY OF THE INVENTION

Thus, it is an object of the present invention to provide a method for the analysis and synthesis of voice signals, wherein in each channel the voice signals are evaluated on the basis of the amplitude level of the particular channel with regard to the presence or absence of silence signals, and then the signals of the channel which do not require coding are compressed.

Another object of the invention is to provide an apparatus for carrying out the above-mentioned method of analysis and synthesis of voice signals.

According to the invention, the first object can be achieved by evaluating the amplitude level of an output signal of each subdivision channel in each predetermined interval of time (frame length), and coding only those channel output signals for which the above-mentioned amplitude level exceeds a predetermined reference level established for each channel.

The second object of the invention, which relates to an apparatus for the analysis and synthesis of voice signals, is achieved by providing an amplitude level detector which detects the amplitude level of each subdivision channel signal in a predetermined time interval (frame length), and an analysis-side silence detector which has level evaluation units, which compares the above-mentioned amplitude levels with reference levels established for each subdivision channel, to determine whether the voice signal is present or absent, and outputs to the respective coders, a signal for causing coding of the subdivision channel signals when the voice signal is present and a silence confirmation signal for preventing the coding of the subdivision channel signals when the voice signal is absent, thereby to perform compression.

In implementing the above-mentioned apparatus of the invention, it is preferable to provide a synthesis-side silence detector for the supply to the decoder of decoding signals for decoding the coded subdivision channel signals from the analysis side only when the voice signal is present, and of silence confirmation signals for reducing the output of the decoder to the zero level when the voice signals are absent.

Furthermore, in a preferable embodiment of the apparatus of the invention, the above-mentioned amplitude level detector has an absolute-value generation circuit which produces at its output an absolute value of the amplitude level of each subdivision channel signal, and a maximum-value detection circuit which produces at its output the maximum of the above-mentioned absolute value of the amplitude level within the frame length.

Also in another embodiment of the apparatus of the invention, the level evaluation unit is provided with: a quantization level-conversion coding circuit for converting the above-mentioned maximum amplitude level into a quantization level for determining the quantization step-size of the coder; an analysis-side silence-signal confirmation circuit which outputs as a silence confirmation signal the result of coding of the quantization level at the moment of absence of voice signals when the quantization level does not exceed the reference level, and outputs the result of coding the quantization level, at the moment of presence of voice signals when the quantization level exceeds the reference level; and an analysis-side quantization-step-size decoding conversion circuit which decodes the results of coding and converts them into the quantization step-size and supplies its output signals to the coders.

The apparatus is preferably further provided with a synthesis-side silence-signal-confirmation circuit, which outputs to the decoder as a silence confirmation signal the results of coding at the moment of absence of voice signals when the results of coding sent to the synthesis side from the analysis side do not exceed the reference level and which outputs the results of coding, at the moment of presence of voice signals when the results of coding exceed the reference level; and a synthesis-side quantization-step-size conversion circuit which converts the results of coding at the moment of presence of voice signals into a quantization step-size for decoding of coded subdivision channel signals supplied from the analysis side to the synthesis side and outputs them to the decoder.

Incidentally, it is not appropriate to set the same evaluation reference level for all of the channels. It is proposed to select an evaluation (judgement) reference level i.e., silence levels for each of the channels depending on the frequency band of each channel.

According to the first and second embodiments of the invention, a predetermined time interval is established within the range of 5 to 30 ms, over which the voice signals can be regarded as being essentially steady, and then within each such frame length, determination is carried out with regard to the presence or absence of the voice signals in each channel subdivided with regard to the frequency band. An output with regard to each channel is transmitted to coding only in those cases where judgement confirms that in the evaluated interval a voice signal is present in this channel. In the case of a silence interval, the output of this channel is not coded, the information is compressed, and a zero level signal appears on the synthesis side as a result of decoding.

DETAILED DESCRIPTION OF THE PREFERRED EMBODIMENTS

Embodiments of the invention will now be described in detail with reference to the accompanying drawings.

Figure 1:
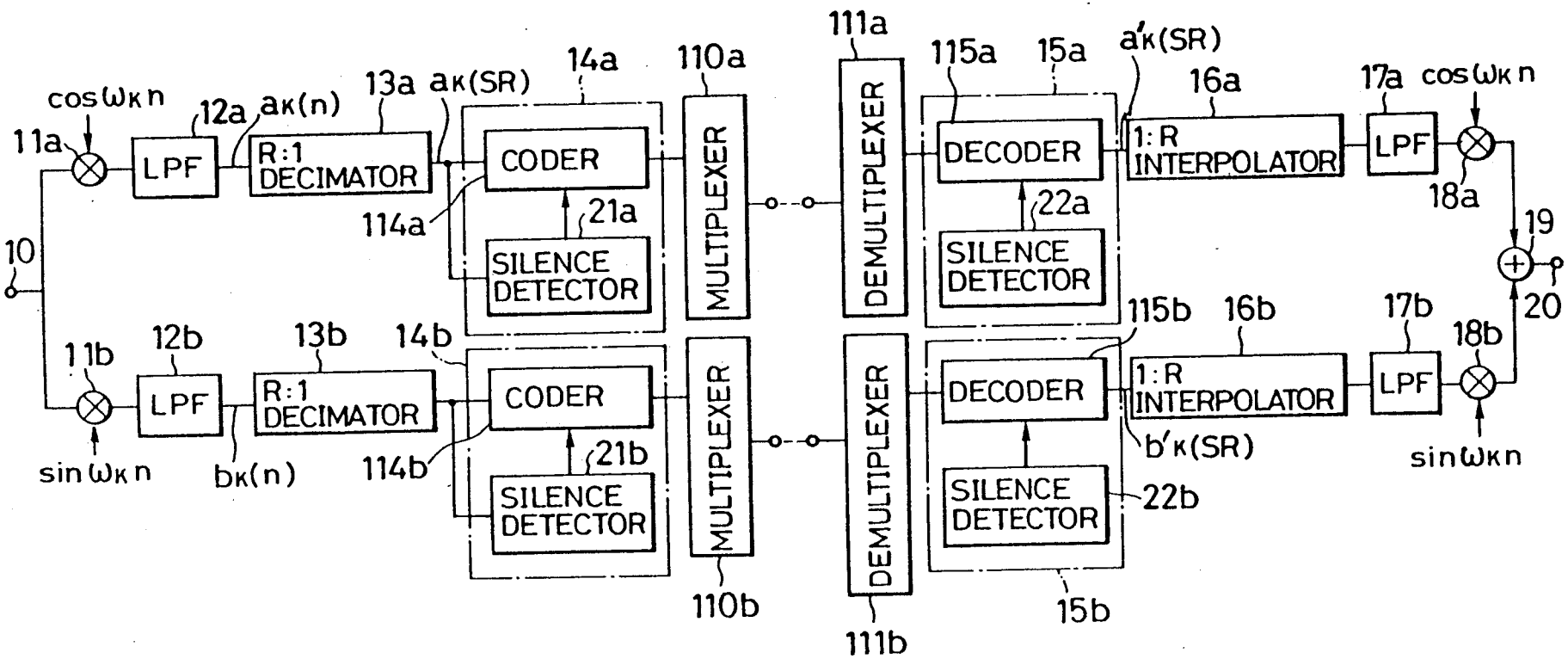
FIG. 1 is a block diagram illustrating an example of an SBC-type voice analysis and synthesis apparatus constructed in accordance with the present invention.
Figure 7:
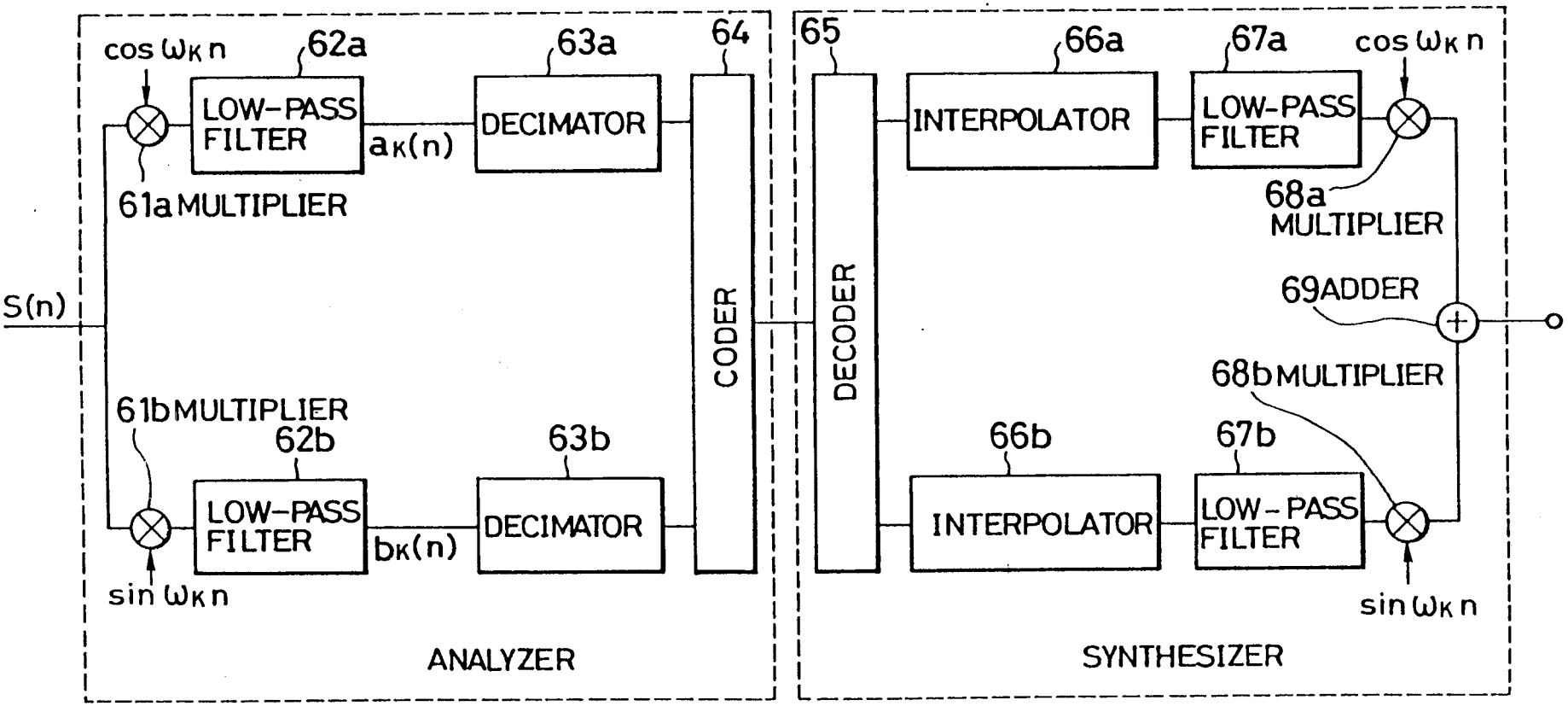
FIG. 7 PRIOR ART
FIG. 7 is a structural block-diagram of another modification of the conventional SBC-type voice analysis and synthesis system.

FIG. 1 is a block diagram which illustrates an embodiment for the case where the invention is incorporated into a band-subdivision-type voice synthesizer of the SBC-system shown in FIG. 7. An APCM system is used for coding each component channel. FIG. 1 shows the arrangement with regard to only one channel.

In FIG. 1, reference numeral 10 designates an input terminal, 11*a* and 11*b* are multipliers, 12*a* and 12*b* represent low-pass filters (LPF), 13*a* and 13*b* correspond to R:1 type decimators. All these devices form an analyzer-side block. Structural elements of the analyzer are shown in FIG. 7. The same drawings show a synthesis-side block which consists of 1:R type interpolators 16*a* and 16*b*, low-pass filters 17*a* and 17*b* (LPF), multipliers 18*a* and 18*b*, an adder 19, and an output terminal 20. Reference numerals 14*a* and 14*b* may comprise, e.g., APCM coders, 15*a* and 15*b* are APCM decoders. The construction of these APCM coders 14*a* and 14*b*, and APCM decoders 15*a* and 15*b*, suitable for the purpose of the invention, will be further described in detail.

Similar to conventional practice, these devices divide the frequency bands of voice signals into several subbands, and then code and synthesize each subdivision separately.

According to the invention, the analysis block is provided with silence-signal detectors 21*a* and 21*b* which detect silence intervals in each band-subdivided channel and, instead of coding, provide compression of these silence intervals. On the other hand, the synthesis block is equipped with silence-signal detectors 22*a* and 22*b* which reduce to zero the signals for silence-signal intervals corresponding to decoded signals obtained from decoders 115*a* and 115*b* in APCM decoding units 15*a* and 15*b*. Thus, in the present embodiment, the above-mentioned silence-signal detectors 21*a*, 21*b* and 22*a*, 22*b* are elements which perform APCM processing functions in respective APCM coders 14*a*, 14*b* and APCM decoders 15*a*, 15*b*. Reference numerals 110*a* and 110*b* designate multiplexers which will be described later, and reference numerals 111*a* and 111*b* designate demultiplexers which will be described later as well.

Figure 2A:
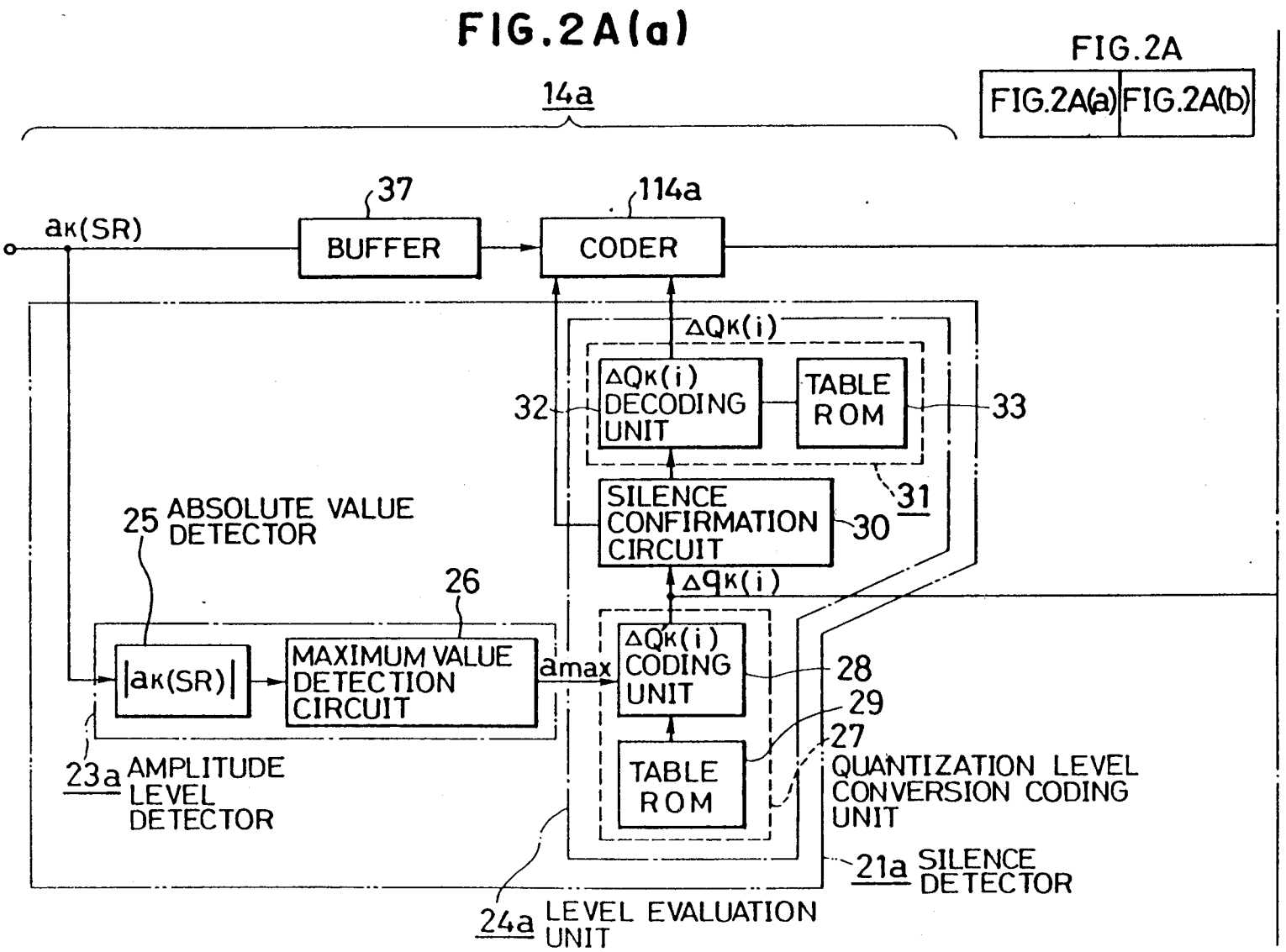
FIG. 2A, which consists of FIGS. 2A(*a*) and 2A(*b*), is a block diagram of an element of the apparatus of FIG. 1.
Figure 2A:
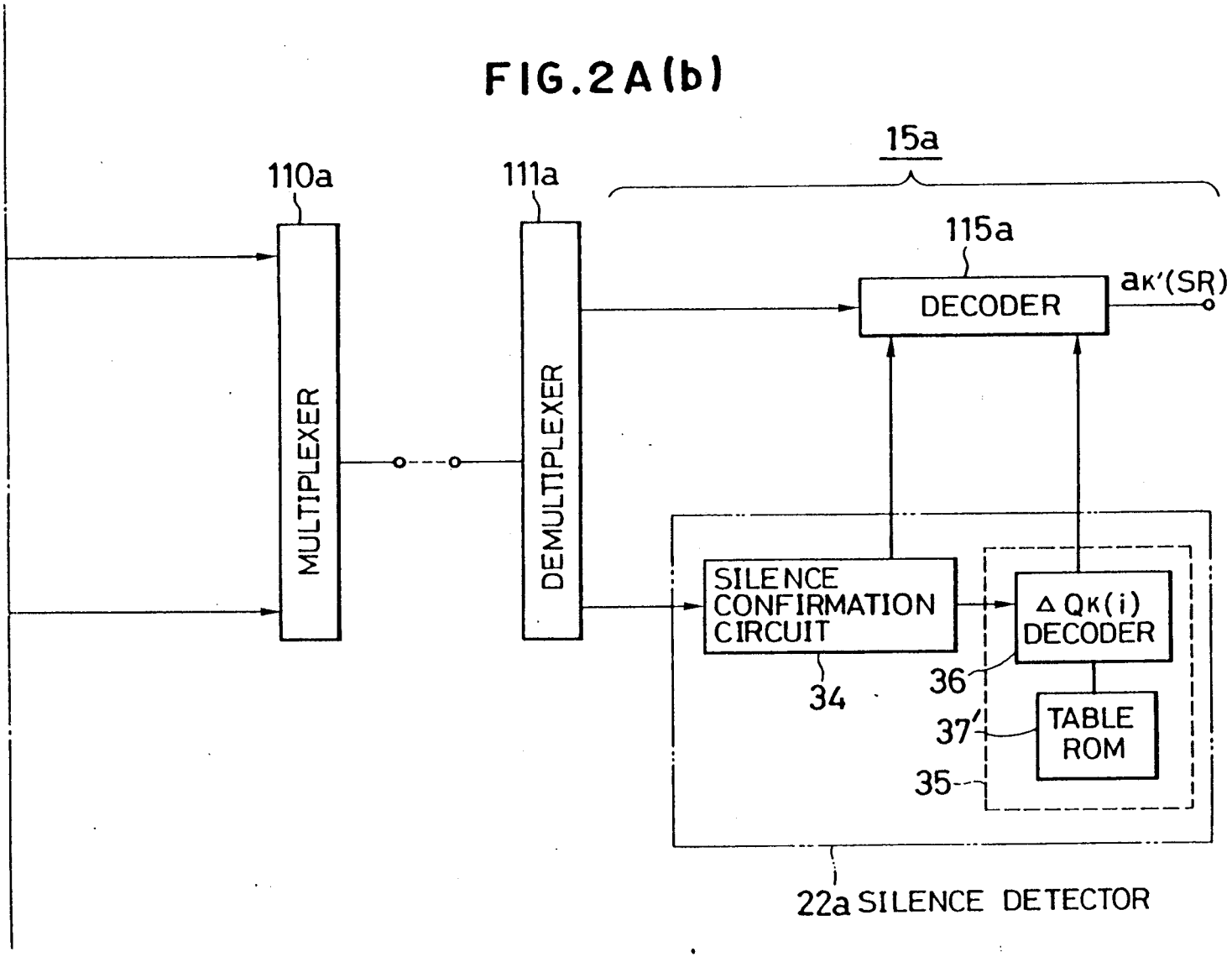

FIG. 2A shows a block diagram of an essential part of the device corresponding to the present invention. Because the block which corresponds to a cosine component unit from 11*a* to 18*a* in FIG. 1 is identical in its operation to that of a sine component unit from 11*b* to 18*b* with the only difference being that the wave is modulated by cosine or sine, the further description will relate only to the components of the cosine side.

Operation of the device of the first embodiment will be now described with reference to FIGS. 1 and 2A.

When a digitized voice signal enters the device through input terminal 10, in response to this signal, multiplier 11*a* modulates the amplitude by multiplying it by a cosine waveform ($\cos\omega_k t$) having the same frequency as the central frequency of the channel. Here, k is the channel's number. The cosine-modulated voice signal is passed through a low-pass filter 12*a* having a bandwidth of $\frac{1}{2}\omega_k$. This produces an output signal $a_k(n)$ of the cosine component of the respective channel. In decimator 13*a*, the output signal $a_k(n)$ of low-pass filter 12*a* is subjected to decimation of a sample (R:1) which corresponds to the ratio of (channel bandwidth)/(sampling frequency of the initial signal). The result of this sampling $a_k(SR)$ is coded and transmitted by coder 114*a* of APCM coding unit 14*a*.

For the coding, an APCM coding system is used. Utilized in the present embodiment, however, is a segmental APCM (SAPCM) which allows determination of a quantization step-size in each interval, with subsequent quantization based on the use of the quantization step-size determined with regard to data contained in each respective interval.

Compression of silence intervals, which is the distinguishing feature of the present invention, also is carried out with SAPCM coding. The coding procedure will now be described.

FIG. 2A is a block diagram of a system composed of silence signal detectors 21*a* and 22*a*, which in accordance with the present invention are introduced into the system for required processing in APCM coder 14*a* and APCM decoder 15*a* shown in FIG. 1.

In this embodiment, an analysis-side silence-signal detector 21a is composed of an amplitude level detector 23a and a level evaluation unit 24a. Amplitude level detector 23a detects the amplitude level of an output signal $a_k$(SR) which is a sub-band channel signal in each predetermined time interval, i.e., in each frame length. On the other hand, level evaluation (judgement) unit 24a compares the detected amplitude level with the reference level determined for each channel and makes a judgement on whether a sound signal is present or not. When a sound signal is present and the amplitude level exceeds the reference level, the coding information for coding only output signals of the sub-band channels is sent to a coder 114a. If, on the other hand, the amplitude level of the interval does not exceed the reference level, coding is not performed, and a silence confirmation signal is sent to coder 114a for not performing coding and performing compression.

Normally, in the case of coding of output signal $a_k$(SR) obtained after decimation, it is necessary to determine a quantization step-size $\Delta Q_k(i)$ (where i is a frame number) in the frame.

The preferred embodiment of the invention will now be described with regard to the analysis-side silence-detector 21a, for the case of formation of the above-described silence-confirmation signal and coding information signal utilizing the process for determining the quantization step-size $\Delta Q_k(i)$. In this case, the quantization step-size (which hereinafter will be referred to simply as "step-size") $\Delta Q_k(i)$ is so determined that the maximum value of signal $a_k$(SR) in the frame is equal to a dynamic range of quantization.

First, an absolute value $|a_k(SR)|$ of the amplitude level for each sub-band channel signal $a_k$(SR) is calculated in a absolute value detector 25 in amplitude level detector 23a of the apparatus, and then in maximum value detection circuit 26 a value $a_{max}$ within the frame is determined as the maximum amplitude level. This maximum value $a_{max}$ is transmitted to level evaluation unit 24a.

Since the step-size $\Delta Q_k(i)$ used for coding is also used in decoder 115a, a quantization level $\Delta Q'_k$ (i) which determines the above-mentioned step-size $\Delta Q_k(i)$ should be transmitted to the synthesis side. Therefore, the thus-determined maximum value $a_{max}$ is subjected to logarithmic companding in a quantization level conversion coding circuit 27 for reduction of the bit number and is transmitted to the synthesis side. Such coding of the maximum value $a_{max}$, i.e., its conversion to a quantization level $\Delta Q'_k(i)$, is performed with the use of a table. For this purpose, in the device of the present embodiment, the above-mentioned quantization level conversion coding circuit 27 has a $\Delta Qk(i)$ coding unit 28 and a table ROM 29.

Figures 3A, 3B, 4:
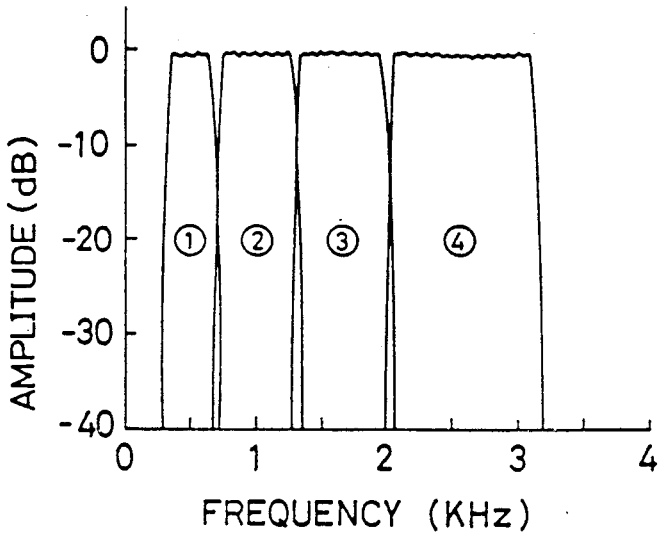
FIG.4 PRIOR ART
FIGS. 3A and 3B show the content of the table ROM used in conjunction with the present invention.
FIG. 4 is a graph which is used for explanation of the SBC system.
Figure 5:
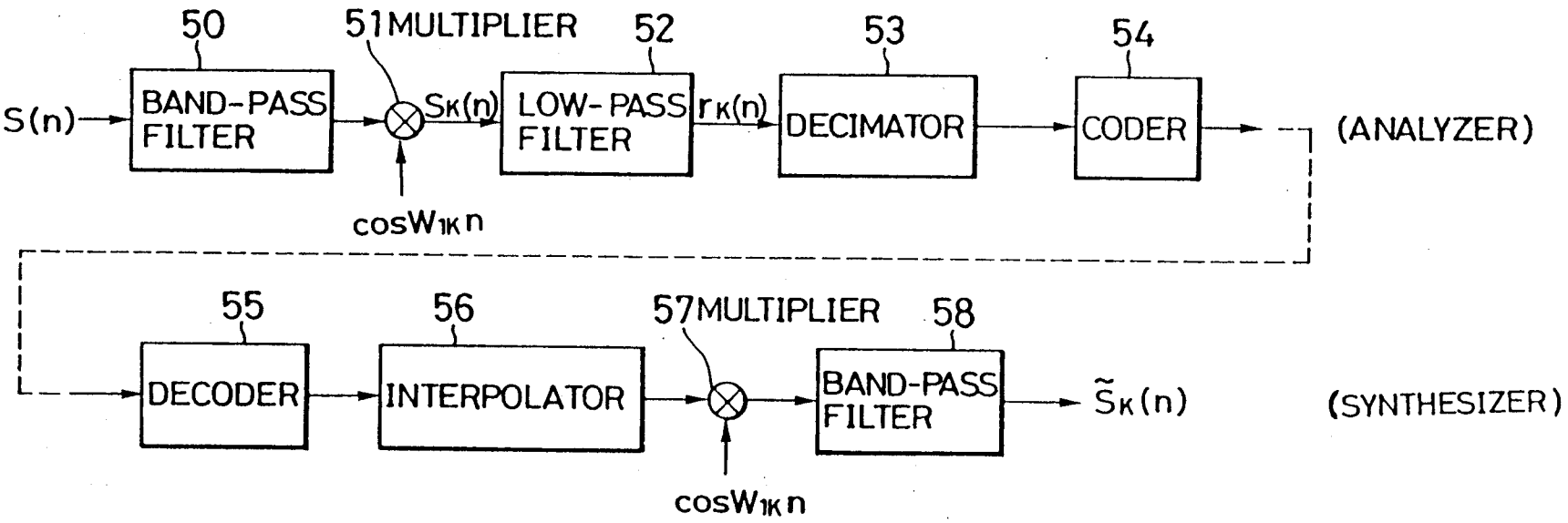
FIG. 5 PRIOR ART
FIG. 5 is a block diagram of a conventional SBC-type voice analysis and synthesis apparatus.
Figures 6A, 6B, 6C, 6D, 6E:
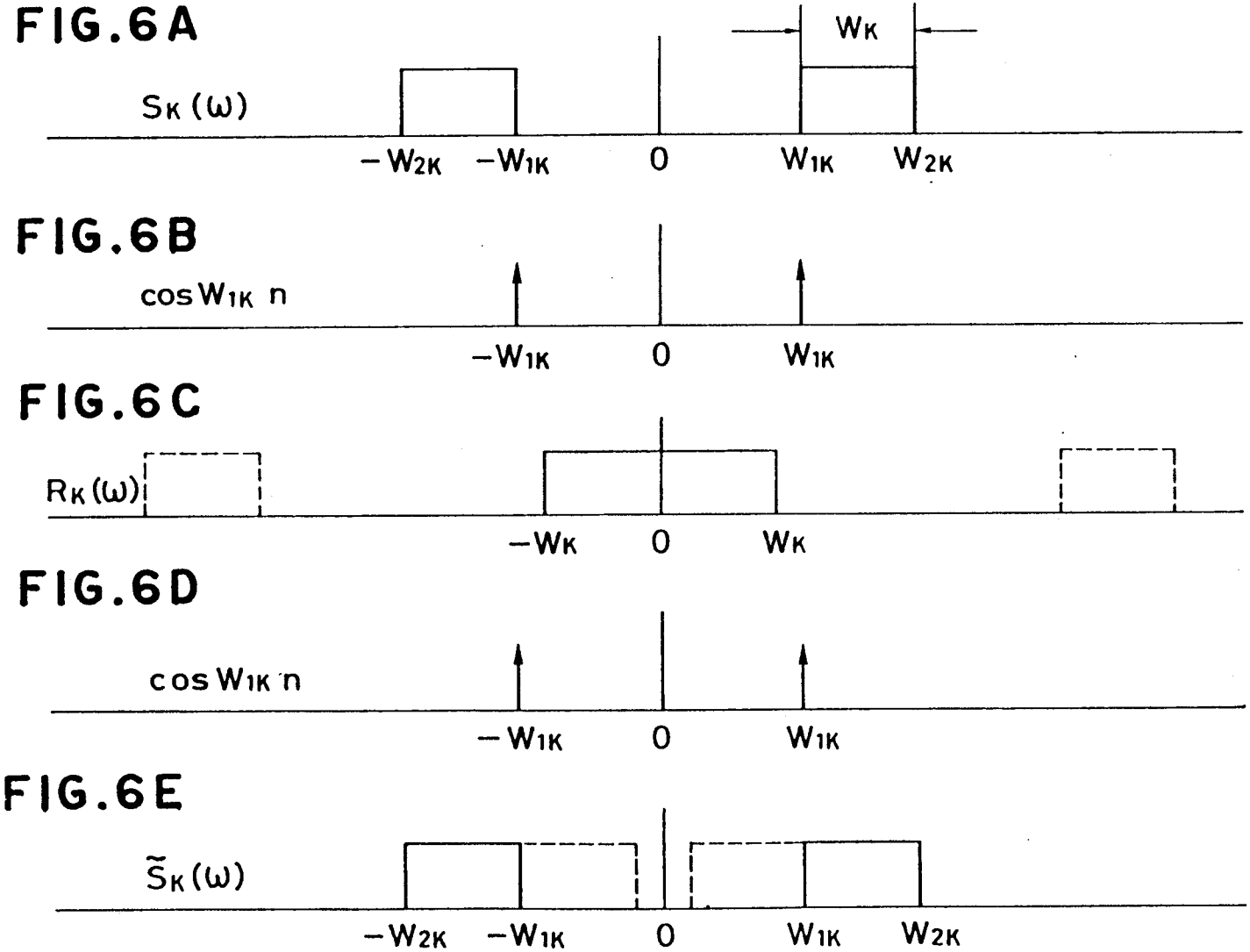
PRIOR ART FIG.6A
FIG. 6 is a graph which explains the operation of the apparatus of FIG. 5.

As shown in FIG. 3A, table ROM 29 stores the maximum quantization levels in the ascending order allocated logarithmically over the entire dynamic range of channel output signals $a_k$ (SR). Such allocation is different depending on the channels, but in this case the levels are allocated in (M+1) stages where M is a positive integer. In FIG. 3A, the stages from 0 to M are shown on the left side of the table. Located on the right from these numbers are the corresponding quantization levels, i.e., quantization level)$_0$ . . . (quantization level)$_M$.

The above-mentioned quantization levels are successively compared in $\Delta Q'_k(i)$ coding unit 28 with the currently determined maximum values $a_{max}$, so that when the result of quantization (quantization level)$_j$ satisfies the condition: (quantization level)$_{j-1} < a_{max} \leqq$ (quantization level)$_j$, (the quantization level)$_j$ is regarded as the result of quantization and the index j is output as a coding result $\Delta Q_k(i)$. A silence threshold value is stored in (quantization level)$_0$ of the table ROM 29. Appearance of when a zero output on the $\Delta Q'_k(i)$ coding unit 28 confirms that a silence interval is present in the frame.

Thus, the analysis-side silence-confirmation or decision circuit 30 which is incorporated in level evaluation unit 24a makes a judgement as to whether or not a quantization level $\Delta Q'_k(i)$ which is received from the $\Delta Q'_k(i)$ coding unit 28 exceeds a predetermined reference level. More specifically, in the illustrated embodiment, judgement is made on whether value j, which is a coding result $\Delta q_k(i)$, is equal to zero or not, and if it is equal to zero, a one-bit silence confirmation signal is sent from the above-mentioned analysis-side silence-confirmation circuit 30 to coding unit 114a, which thereby does not produce coding data, to achieve compression of the information. Such compression, which is based on the silence signal information, can be performed with the use of any suitable system.

In the illustrated embodiment, an output signal of the i frame is considered as a signal from a silence frame, and when the silence confirmation signal j=[0], which is the result of coding $\Delta q_k(i)$, is sent to coding unit 114a, the latter receives from a buffer circuit 37, which is incorporated into the front stage of coding device 114a, the latter receives from a buffer circuit 37, which is incorporated into the front stage of coding device 114a, a series of component signals from each frame: . . . (i−1) frame, *framer*, (*i*+1) frame. However, the component signal from i frame is not coded. As a result, coding unit 114a will successively transmit to the synthesis side the results of coding of . . . (i−1) frame, then (i+1) frame . . . When, on the other hand, the quantization level $\Delta Q'_k(i)$, which is received from $\Delta Q'_k(i)$ coding unit 28, exceeds a predetermined reference level, i.e., in the case where value j, which represents the coding result $\Delta q_k(i)$, is not equal to zero, the above-mentioned coding result $\Delta q_k(i)$, i.e., value j, is transmitted to an analysis-side quantization-step-width decoding conversion circuit 31, where the signal is converted into the quantization step-size $\Delta Q_k(i)$. The above-mentioned analysis-side quantization-step-size decoding conversion circuit 31 comprises a $\Delta Q_k(i)$ decoding unit 32 and a table ROM 33. Decoding unit 32 decodes $\Delta q_k(i)$ to obtain the quantization step-size $\Delta Q_k(i)$ which corresponds to the coding result $\Delta q_k(i)$ (value j), sends the results to coding unit 114a, and the component signals $a_k$(SR) from the corresponding frame are quantized.

For decoding, table ROM 33 stores, as $\Delta Q_j$, the quantization step-size $\Delta Q_k(i)$ which corresponds to value j (=1 to M) representing coding results $\Delta q_k(i)$ of the quantization level $\Delta Q'_k(i)$ of the maximum value $a_{max}$. By reference to table ROM 33, decoder 32 creates a step-size $\Delta Q_j$ and transmits it to coding unit 114a. An example of the content of table ROM 33 is shown in FIG. 3B. Values j (=1to M) are shown on the outer left side of the table, while receptive lines of the table contain step-sizes $\Delta Q_j$(j=1 to M) which correspond to values j of the quantization step-sizes $\Delta Q_k(i)$.

Incidentally, if the quantization bit number on coder 114a is equal to p, then $\Delta Q_j$ will have a value equal to [(quantization level)$_j/2^{p-1}$g.

Thus, for each sub-band channel signal, the analysis side of the apparatus decides whether the silence or voice signal is present, and performs coding of the sub-band channel signals only in the case of the voice signal, while in the case of a silence interval the respective sub-band channel signal is not coded. In this way, the signals are compressed and sent to the synthesis side of the apparatus.

Figure 2B:
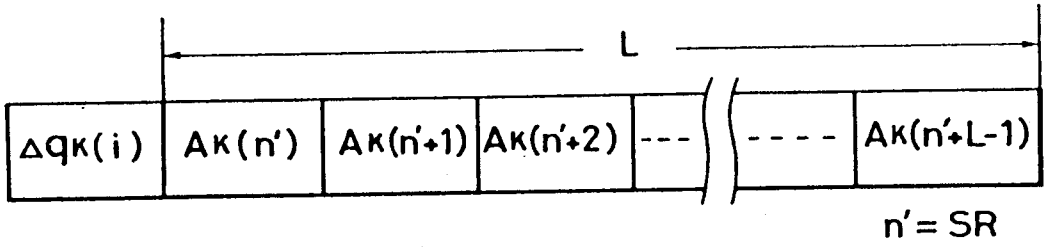
FIGS. 2B to 2D show the arrangement of the frame data sent from the analysis side to the synthesis side.
Figure 2C:
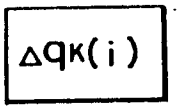
Figure 2D:
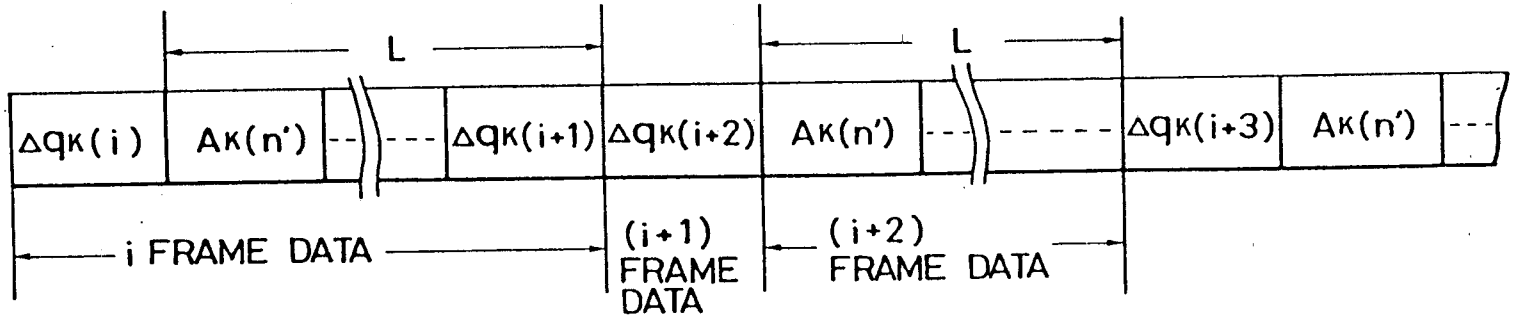

FIG. 2B will now be used for explanation of the frame data arranged by the multiplexer 110a containing coding results $\Delta q_k(i)$ of quantization level $\Delta Q'_k(i)$ and coding results $A_k(SR)$ obtained by coding at coder 114a the sub-band channel signal $a_k(SK)$ in the case of the voice interval that has been arranged by the multiplexer 110a and will be sent out. FIG. 2C is a similar explanatory diagram of the frame data in the case of a silence interval. FIG. 2D will be used for explanation of the arrangement of the frame data received from multiplexer 110a in the case when the (i+1) frame does not have voice signals, and frame i and (i+2) correspond to voice signals.

As will be seen from FIG. 2B, when the frame length corresponds to a number L (where L is a positive integer) of samples after the decimation, with the presence of a voice sound in the i frame, the frame data will contain in its head portion the coding results $\Delta q_k(i)$ of the quantization level, and in the following portion the coding results of sequentially arranged L sub-band channel signals, i.e., $A_k(n')$, $A_k(n'+1) \ldots A_k(n'+L-1)$ (where $n'=SR$).

When the i frame is a silence interval, coding unit 114a will not produce the coding results $A_k(i)$ of the sub-band channel signals, and therefore the frame data contains only the coding results $\Delta q_k(i)$ of the quantization level as shown in FIG. 2C.

When the i frame is a voice interval, the (i+1) frame is a silence interval, and the (i+2) frame also is a voice interval, then as shown in FIG. 2D, the frame data of the i frame will contain in the head portion the coding results $\Delta q_k(i)$ of the quantization level, and in the remaining part the coding results of the L sub-band channel signals of the i frame, i.e., $A_k(n')$, $A_k(n'+1) \ldots A_k(n'+L-1)$. These signals will be followed by the coding results $\Delta q_k(i+1)$ of the quantization level of the (i+1) frame, and then again by the coding results $\Delta q_k(i+2)$ of the quantization level of the (i+2) frame followed by a series of coding results $A_k(n')$ of the L sub-band channel signals $A_k(n'), \ldots A_k(n'+L-1)$.

Meanwhile, on the synthesis side, the frame data transmitted from the analysis side are separated by demultiplexer 111a into coding results $\Delta q_k(i)$ of the quantization level and coding results $A_k(SR)$ of the sub-band signal, and the coding results $\Delta q_k(i)$ of the quantization level are then received by synthesis-side silence detector 22a. In the illustratrated embodiment, the above-mentioned silence detector 22a contains a synthesis-side silence signal confirmation or decision circuit 34 and a synthesis-side quantization-step-size decoding conversion circuit 35. When in the above-mentioned synthesis-side silence signal confirmation circuit 34 (similar to the analysis-side silence signal confirmation circuit 30) the quantization level $\Delta Q'_k(i)$ which corresponds to the coding results $\Delta q_k(i)$ does not exceed a predetermined reference level, i.e., when it is determined that $j=0$, the silence confirmation signal is sent to decoder 115a, which produces at its output a signal corresponding to a zero level for a respective section of the frame. When the quantization level $\Delta Q'_k(i)$ corresponding to the transmitted coding results $\Delta q_k(i)$ is not equal to zero, similar to the analysis side, $\Delta Q_k(i)$ decoder 36 refers to table ROM 37', produces as a decoding signal a quantization step-size $\Delta Q_j$, supplies the result to decoder 115a, which with the use of the quantization step-size $\Delta Q_j$ decodes the coding results $A_k(SR)$ quantized on the analysis side, and produces a sub-width channel signal $a'_k(SR)$. Quantization-step-size decoding conversion circuit 35, which is located on the synthesis side, operates in the same manner as the earlier described quantzation-step-size decoding conversion circuit 31 located on the analysis side.

Referring now back to FIG. 1, the decoded sub-band channel signal $a'_k(SR)$ is interpolated by interpolator 16a, returned to its initial sampling cycle, passed through low--ass filter 17a, multiplied with $\cos \omega_k n$ in a multiplier 18a, and then again returned to its initial frequency band.

The same processing is performed with regard to other channels, and at the final stage, the output results of all channel are summed and produced as output results of synthesis.

It should be understood that the scope of the present invention is not limited only to the embodiments described and shown, and that other modifications and changes are possible.

For example, the above-described embodiments were explained with reference to the segment APCM system. The invention, however, is not limited only to this system and is applicable to any band-division-type signal coding method and apparatus.

Furthermore, in the illustrated embodiments, APCM processing of signals is conducted with the use of a synthesis-side silence detector and an analysis-side silence detector. It is possible, however, to perform the APCM processing independently by means of a separate circuit, so that the function of the detectors will be reduced only to detection of silence signals.

In addition, in the embodiments described above, detection of silence intervals was carried out with the use of the maximum amplitude level, but the same purpose can be achieved by utilizing an average amplitude level. In the illustrated embodiments, derivation of the quantization step-size was utilized so that the level evaluation unit 24a comprises the quantization level conversion coding circuit 27, analysis-side silence confirmation circuit 30 and analysis-side quantization-step-size decoding conversion circuit 31. It is possible, however, to realize the above-mentioned level evaluation unit 24a in a different structural form. In the case where the process of the derivation of the quantization step-size is not utilized and compression is carried out by coding only the voice signal intervals without coding the silence intervals, the level evaluation circuit 24a may comprise an analysis-side silence signal confirmation circuit which compares the amplitude level with a reference level and transmits the control signal which corresponds to the results of the comparison to coding unit 114a, and a corresponding synthesis-side silence signal confirmation circuit may have a corresponding configuration.

Because in accordance with the present invention, the data of components of channels which do not contain voice signals and which contain but little voice signals are removed, it becomes possible to form synthesized sounds with a smaller amount of information. Because the presence of silence signals is evaluated in each channel, unwanted noise components can be reduced, and the quality of the resulting synthesized sound can be improved.

What is claimed is:

1. A band-subdivision-type apparatus having analysis and synthesis sides for the analysis and synthesis of voice signals, in which the frequency band of the voice signals is divided into a plurality of subdivided channels and the voice signals are divided into subdivided channel signals which fall within the respective subdivided channels, said apparatus comprising:

coding means provided on said analysis side for each subdivided channel for separately coding the subdivided channels signal by the use of a quantization step size signal determined for each of a plurality of frames, a frame being defined as a predetermined time interval of said subdivided channel signal;

decoding means provided on said synthesis side for each subdivided channel for receiving said coded subdivided channel signal from said analysis side and decoding said coded subdivided channel signal;

an analysis side amplitude level detector for detecting the amplitude level of said subdivided channel signal in each frame and providing an output corresponding thereto;

an analysis side quantization level conversion coding circuit coupled to the output of said amplitude level detector for quantizing said amplitude level for each frame to determine a quantization level, said quantization level conversion coding circuit converting said quantization level into a coded quantization level signal;

an analysis side silence signal decision circuit coupled to said quantization level conversion coding circuit for receiving said coded quantization level signal and making a decision as to whether the quantization level signal exceeds a predetermined level, said decision circuit outputting a decision signal to said coding means to indicate whether the quantization level exceeds a reference level; and an analysis side quantization step size decoding conversion circuit interposed between said quantization level conversion coding circuit and said coding means for receiving and decoding said coded quantization level signal into said quantization step size signal, said coding means receiving said quantization step size signal and using it for the coding of said subdivided channel signal of each frame;

whereby said coding means effects the coding of the subdivided channel signal within each frame when the decision signal for that frame received from said analysis side silence signal decision circuit indicates that the amplitude level of said frame exceeds said reference level, and does not effect the coding of the subdivided channel signal within each frame when the decision signal for said frame indicates that the amplitude level of said frame does not exceed said reference level.

2. The apparatus according to claim 1, wherein said amplitude level detector comprises:

an absolute value generation circuit which produces at its output the absolute value of the amplitude level of said subdivided channel signal; and a maximum value detection circuit coupled to the output of said absolute value generation circuit, said absolute value generation circuit producing at its output the maximum of said absolute value of the amplitude level within each frame, said quantization level conversion coding circuit quantizing said maximum level as said amplitude level.

3. The apparatus according to claim 1, wherein said coding means produces, for each frame of which said amplitude level exceeds said reference level, said coded quantization level together with the results of the coding at said coding means; and said coding means further produces for each frame of which said amplitude level does not exceed said reference level, said coded quantization level not accompanied with the results of coding at said coding means.

4. The apparatus according to claim 3, further comprising means for transmitting, from the analysis side to the synthesis side, said coded quantization level and said results of coding that are produced from said coding means.

5. The apparatus according to claim 4, further comprising:

a synthesis side silence signal decision circuit for receiving said coded quantization level and supplying a silence decision signal to said decoding means, said decoding means decoding said coded subdivided channel signal when it has been transmitted, and producing a signal representing silence for a frame for which said silence decision signal is supplied from said synthesis side silence signal decision circuit.

6. The apparatus according to claim 5, further comprising:

a synthesis side quantization step size conversion circuit coupled to said synthesis side silence signal decision circuit and to said decoding means for converting said coded quantization level into a quantization step size, said decoding means using said quantization step size produced from said synthesis side quantization step size conversion circuit for the decoding of said coded subdivided channel signal that has been transmitted from said coding means.

* * * * *